US006305514B1

(12) United States Patent
Lin et al.

(10) Patent No.: US 6,305,514 B1
(45) Date of Patent: Oct. 23, 2001

(54) OFF-CENTERED DUAL-PURPOSE HANDLE ASSEMBLY FOR WHEELED LUGGAGE

(75) Inventors: Jer Hong Lin, Taipei; Chung Hsien Kuo, Pan-Chiao, both of (TW)

(73) Assignee: Chaw Khong Technology Co., Ltd., Taipei (TW)

( * ) Notice: Subject to any disclaimer, the term of this patent is extended or adjusted under 35 U.S.C. 154(b) by 0 days.

(21) Appl. No.: 09/505,942

(22) Filed: Feb. 15, 2000

Related U.S. Application Data

(60) Provisional application No. 60/120,332, filed on Feb. 17, 1999.

(51) Int. Cl.[7] ..... A45C 13/26; A45C 5/14
(52) U.S. Cl. ..... 190/115; 190/18 A; 190/39
(58) Field of Search ..... 190/39, 115; 16/115–1

(56) References Cited

U.S. PATENT DOCUMENTS 5,908,093 * 6/1999 Miyoshi ..... 190/115
5,950,779 * 9/1999 Miyoshi ..... 190/115 X
5,956,807 * 9/1999 Kuo ..... 16/115
6,026,543 * 2/2000 Chen ..... 190/115 X
6,079,527 * 6/2000 Kuo ..... 190/115

* cited by examiner

*Primary Examiner*—Sue A. Weaver
(74) *Attorney, Agent, or Firm*—Dougherty & Troxell

(57) ABSTRACT

A handle assembly for wheeled luggage is disclosed. The handle grip is off-centered from the center line of luggage in the longitudinal direction across the top of luggage within a predetermined limited distance. The handle assembly further comprises a locking mechanism mounted to the inner tube with locking pins facing each other for engaging three apertures provided in the outer tubes in the handle storage position, the handle for carrying position, or the handle for pulling position. This allows wheels to be away from the legs of user and thus provides a great convenience to user since luggage does not interfere with the user's movement.

16 Claims, 14 Drawing Sheets

OFF-CENTERED DUAL-PURPOSE HANDLE ASSEMBLY FOR WHEELED LUGGAGE

This application claims benefit of Prov. No. 60/120,332 filed Feb. 17, 1999.

FIELD OF THE INVENTION

The present invention relates to a handle assembly for wheeled luggage and more particularly to an off-centered dual-purpose handle assembly that can be used for both carrying and pulling a wheeled luggage and furthermore, when luggage is carried, the lower end of luggage tilts away from the user.

BACKGROUND OF THE INVENTION

Wheeled luggage has been widely used in recent years by travelers in various forms of transportation. When designing a wheeled luggage, a number of important criteria must be considered. For example, luggage should be rigidly constructed for surviving rough handling when pulled in the streets, in and out of buildings with ascending or descending steps, and in and out of various forms of carriers such as airplanes or motor vehicles. The wheeled luggage must also have adequate wheel means such that luggage can be pulled along a pavement with relative ease.

Wheeled luggage should have a convenient pull-handle system that can be easily stowed away when not in use and extended when needed. Most types of luggage of large or medium size sold in markets are equipped with a pull handle of various types so as to facilitate carrying of the same in journey. However, most of pull-handle systems are not suitably designed and cannot be reliably used. For example, in order to carry or lift the wheeled luggage, a separate handle system must be provided on luggage case in addition to the pull-handle system. But such design is unsatisfactory because it protrudes from the surface of luggage case permanently and cannot be retracted into a recess. As such, the requirement for a separate carry handle system not only clutter the simple design of a luggage case, but also increase the cost of luggage.

More recently, the airline industry has strictly enforced the restriction on the dimensions of carry-on luggage that may be brought onboard of an airplane. A protruded carry handle used on a wheeled luggage for carrying purpose further adds to the dimensions and may disqualify a luggage to be carried onboard an airplane. The need for a handle system that can be completely stowed away in a recess built into the luggage case, can be used to both pull luggage on wheels or to carry luggage when needed has been long existing but unfulfilled.

SUMMARY OF THE INVENTION

It is therefore an object of the present invention to provide a wheeled luggage equipped with a pull-handle system that does not have the drawbacks of conventional pull-handle systems.

It is another object of the present invention to provide a wheeled luggage equipped with a dual-purpose handle system that can be used for both pulling luggage on wheels or carrying wheel when needed.

It is a further object of the present invention to provide a wheeled luggage equipped with a dual-purpose handle system that can be locked in at least two operating positions for pulling and carrying luggage.

It is another further object of the present invention to provide a wheeled luggage equipped with a dual-purpose handle system that can be completely stowed away in a bezel when not in use and thus reducing the dimensions of luggage.

It is still further object of the present invention to provide a wheeled luggage equipped with a dual-purpose handle system such that the need for a separate carrying handle is eliminated.

It is still further object of the present invention to provide a wheeled luggage equipped with a dual-purpose, off-entered handle system.

It is still further object of the present invention to provide a dual-purpose handle system that can be locked in a stowed-away position, in a partially-extended or carrying position, e.g., at a distance between about 0.5 inch to about 6 inch from the top of luggage, and in a fully extended position for pulling luggage on wheels. The locking function is provided by a novel locking mechanism that is connected to an end of an inner tube which slidingly engages a cavity in an outer tube for operating the handle system. Two identical inner tubes are used to slidingly engage two identical outer tubes and are mounted on each side of handle grip. A recessed button in the handle grip is used to operate the locking mechanism by a pair of flexible steel cables mounted inside the inner tubes. The locking mechanism which are mounted to the inner tube with locking pins facing each other for engaging at least three apertures provided in the outer tubes for each of the three locking positions, i.e., the handle storage position, the handle for carrying position, and the handle for pulling position.

Another novel feature of the present invention is the positioning of handle grip in relation to the center line of luggage in the longitudinal direction across the top of luggage. The U-shaped handle grip which attaches to the two inner tubes at the two ends of the U-shaped handle grip while the bottom of the U-shaped handle grip is used as the handle grip and a housing for the push button, i.e., the activating device for locking mechanism. The handle grip is designed to be off-centered from the center line of luggage. The off-centered distance may be between about 0.1 inch and about 2 inch to either side of the center line. The off-centered handle grip enables the luggage to be picked up by the handle grip with the lower end of luggage tilting away from the user. The U-shaped handle rip is designed with the opening of the U-shaped handle grip pointing toward the wheels mounted on the backside of the luggage. This allows the backside of luggage, and specifically the wheels to tilt away from the legs of user. The tilt-away feature of the present invention wheeled luggage when luggage is being carried provides a great convenience to the user since it does not interfere with the user's movement or walking.

The above and other objects, features and advantages of the present invention will become apparent from the following detailed description taken with the accompanying drawings.

DETAILED DESCRIPTION OF PREFERRED EMBODIMENTS

Figure 1:
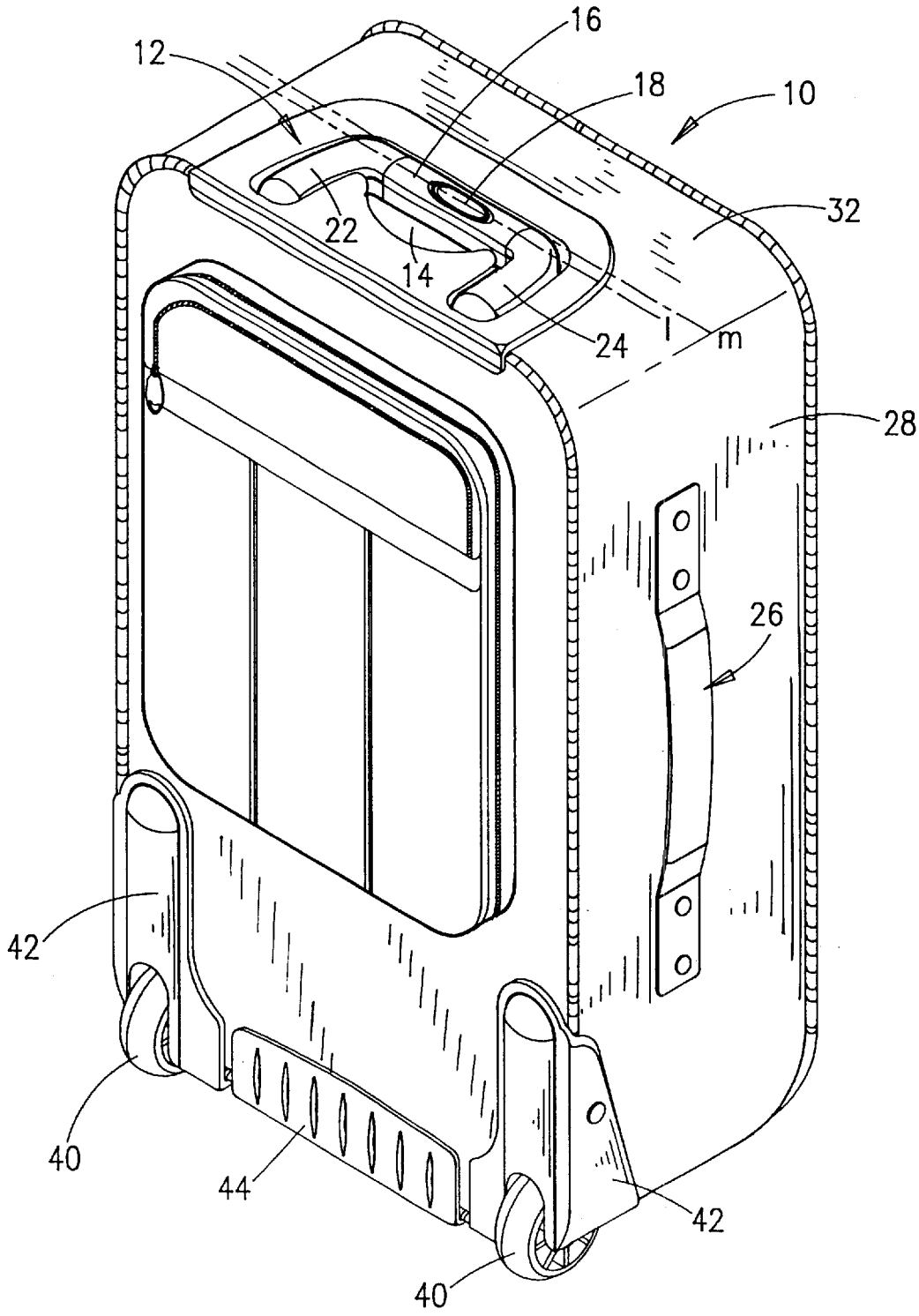
FIG. 1 is a perspective view of the present invention wheeled luggage illustrating the handle grip being mounted to the luggage in an off-centered manner and the handle grip in a stowed-away position.

Referring to FIG. 1, there is shown an off-centered, dual-purpose handle system 12 for a wheeled luggage 10 constructed in accordance with the present invention wherein dual-purpose handle system 12 is in a stowed-away position and stored in bezel 14.

The U-shaped handle system 12 is constructed by a handle grip 16 which houses a recessed push button 18 at a center location connected by two side pieces 22, 24 to the inner tubes (not shown). The wheeled luggage 10 is further equipped with a carrying handle 26 mounted on the side 28 of luggage for carrying the luggage sideways. However, it should be noted that there is no carrying handle provided on the top 32 of luggage 10. The novel handle system 12 of the present invention serves both as a pull handle and as a carrying handle. Note that center line "l" for the handle grip 16 is designed such that it is positioned away from the center line "m" for the top 32 of luggage 10. The distance between two center lines "l" and "m" may be suitably between about 0.1 inch and about 2 inch. It should be further noted that the center line "l" for handle grip 16 can be positioned on either side of the center line "m" for the luggage such that the luggage can be carried with either the wheels toward the user or away from the user. This is further shown in detail in FIGS. 12A–12C and 13A–13C.

Figure 2:
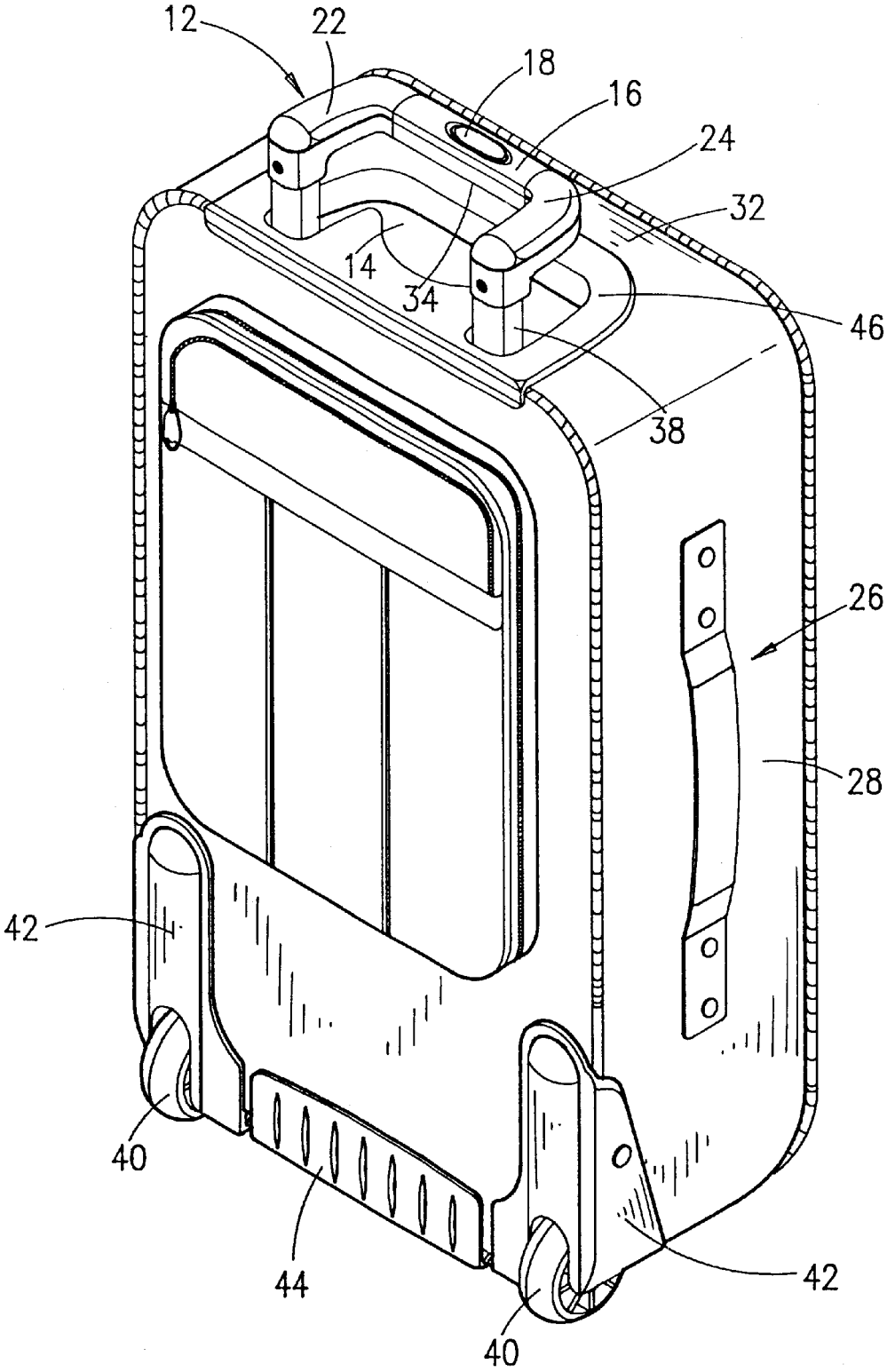
FIG. 2 is a perspective view of the present invention wheeled luggage of FIG. 1 with handle grip partially extended and locked in a carrying position.

FIG. 2 is a perspective view of the present invention wheeled luggage 10 with handle system 12 in a partially extended position for carrying of the luggage. The partially extended handle system 12 may be suitably locked by a locking mechanism (not shown) connected to the inner tubes of handle system 12 at any suitable positions. The handle grip 16 may be at a distance defined between the bottom surface 34 of handle grip 16 and the surface of the top 32 of luggage 10 at between about 0.5 inch and about 6 inch. The distance is determined based on the design of handle grip 16 such that a user can comfortably grip the handle grip 16 with sufficient clearance between the grip 16 and the bezel 14 in the top 32.

Figure 3:
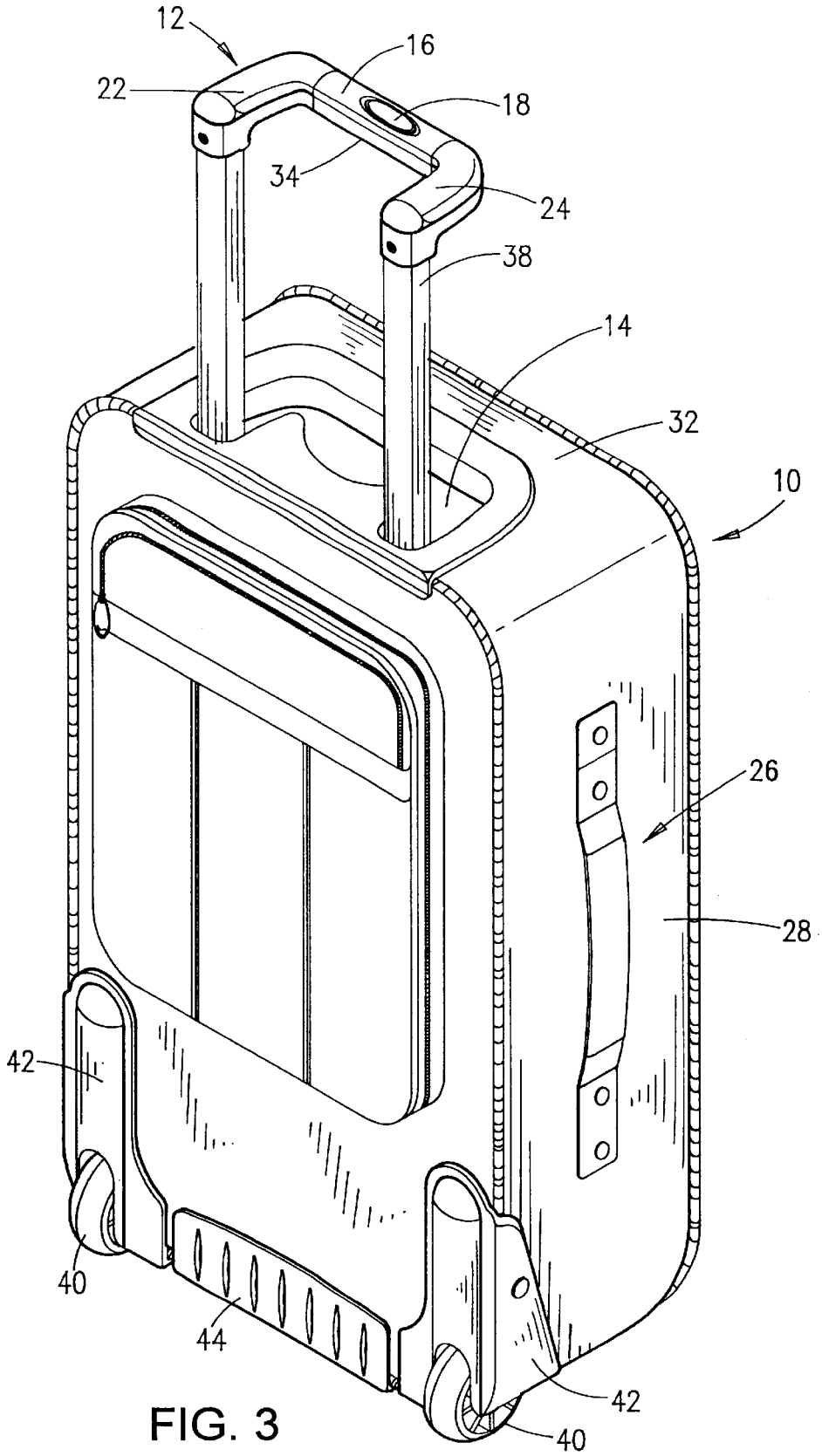
FIG. 3 is a perspective view of the present invention wheeled luggage with handle grip in a fully extended position for pulling the luggage on wheels.

When handle system 12 is pulled out completely such that it is in a fully extended position as shown in FIG. 3, the handle system 12 or handle grip 16 can be used to pull or push the wheeled luggage 10 on its wheels 40. The wheels 40 are mounted in plastic housing 42 with a kick plate 44 mounted therebetween.

Figure 4:
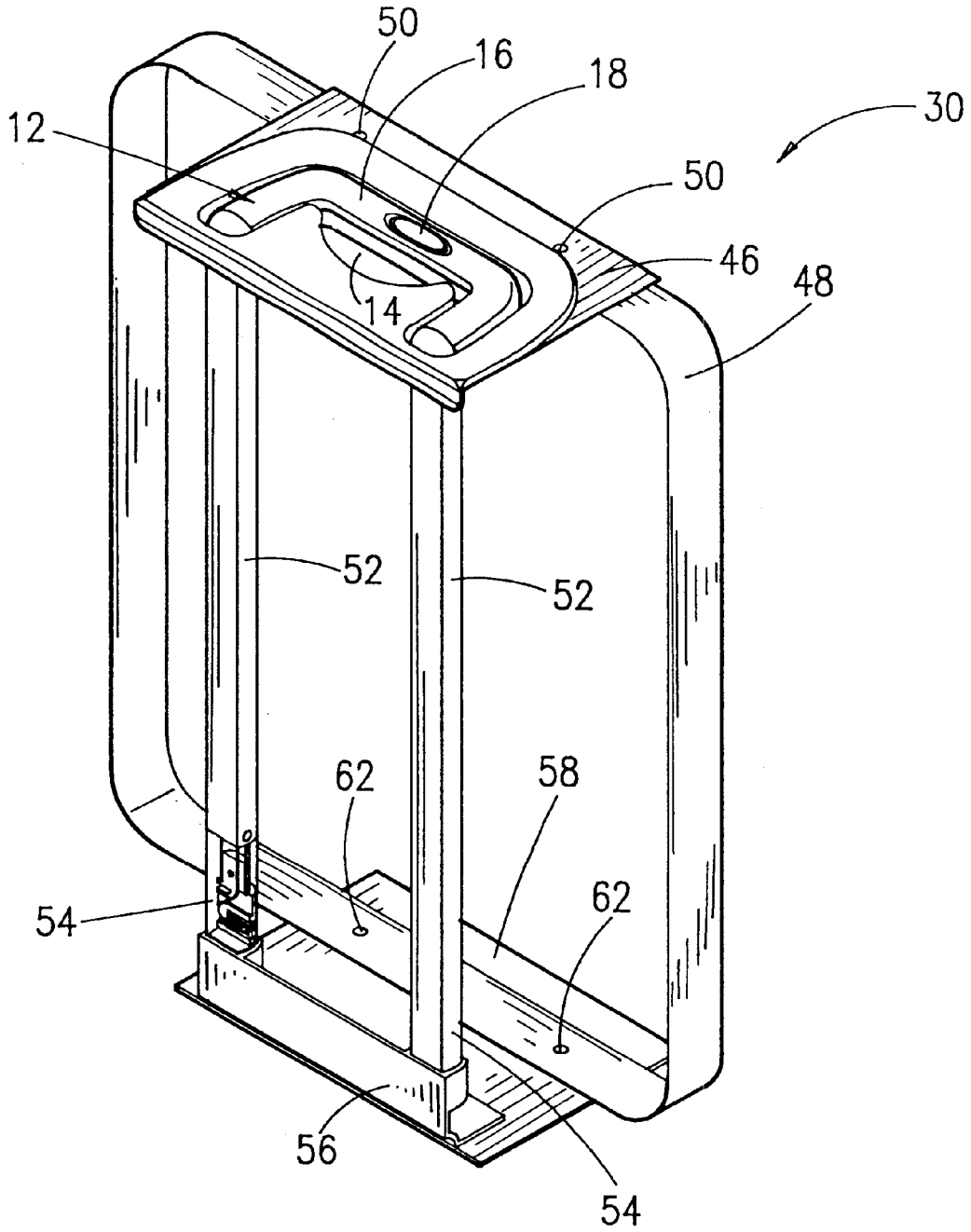
FIG. 4 is a perspective view of the frame of the present invention wheeled luggage with the handle grip in a stowed-away position.

FIG. 4 is a perspective view of frame assembly 30 for wheeled luggage 10. As shown, the handle system 12 is mounted in bezel 14 of a top plate 46 which is further attached to a side frame 48 by attachment means 50. The side frame 48 can be suitably made of a plastic material or of a metal material. The handle system 12 is attached to two inner tubes (not shown) which are stored in two outer tubes 52 with their bottom ends 54 fixed to an end bracket 56 and then to a bottom plate 58 which supports the side frame 48 by attachment means 62.

Figure 5:
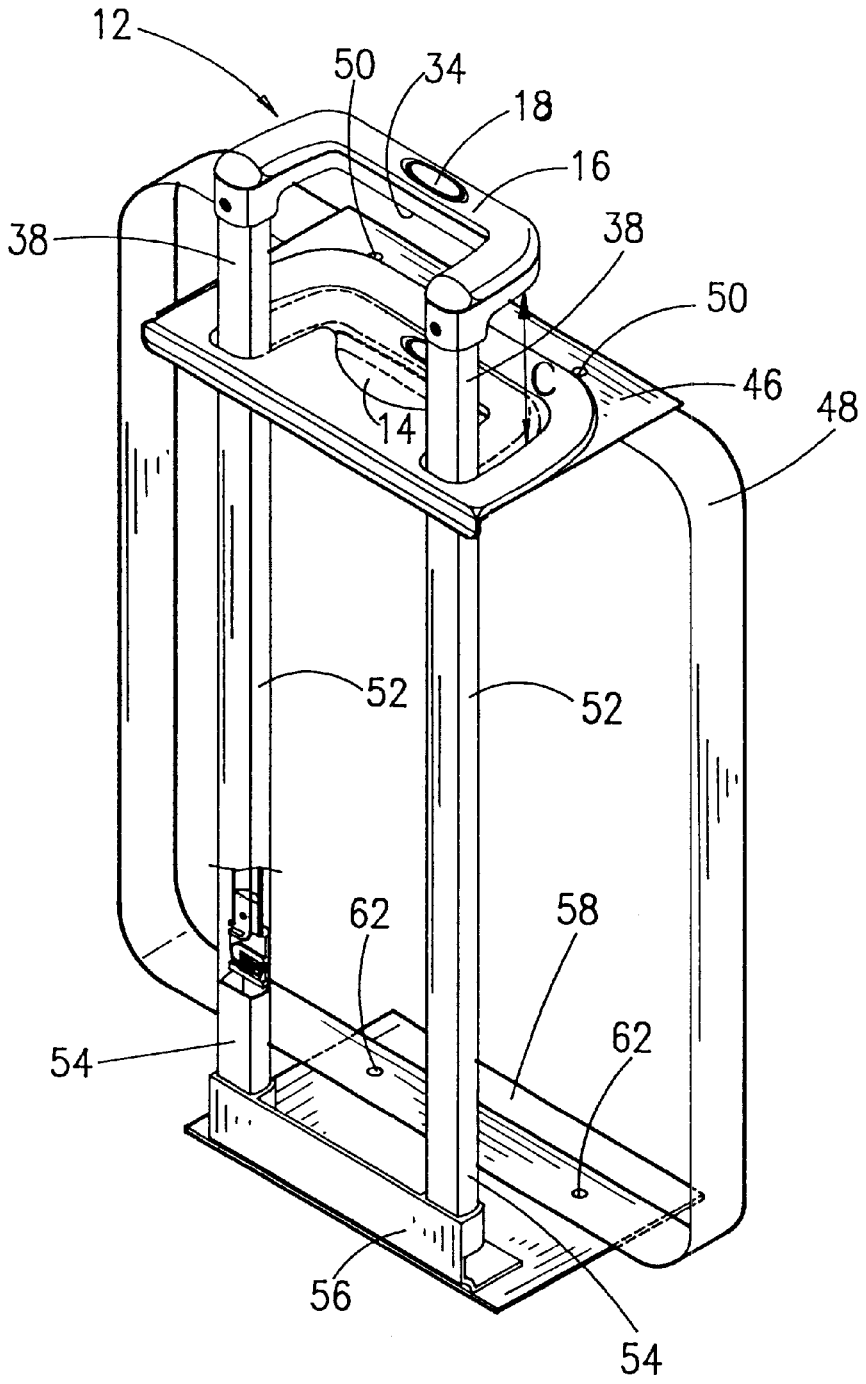
FIG. 5 is a perspective view of the frame of the present invention wheeled luggage with handle grip locked in a carrying position.

FIG. 5 is a perspective view of the frame assembly 30 of FIG. 4 with handle system 12 in partially extended or carrying position. It is seen that the distance between the bottom surface 34 of the handle grip 16 and the surface of top plate 461 represented by "C" in FIG. 5, is between about 0.5 inch and about 6 inch.

Figure 6:
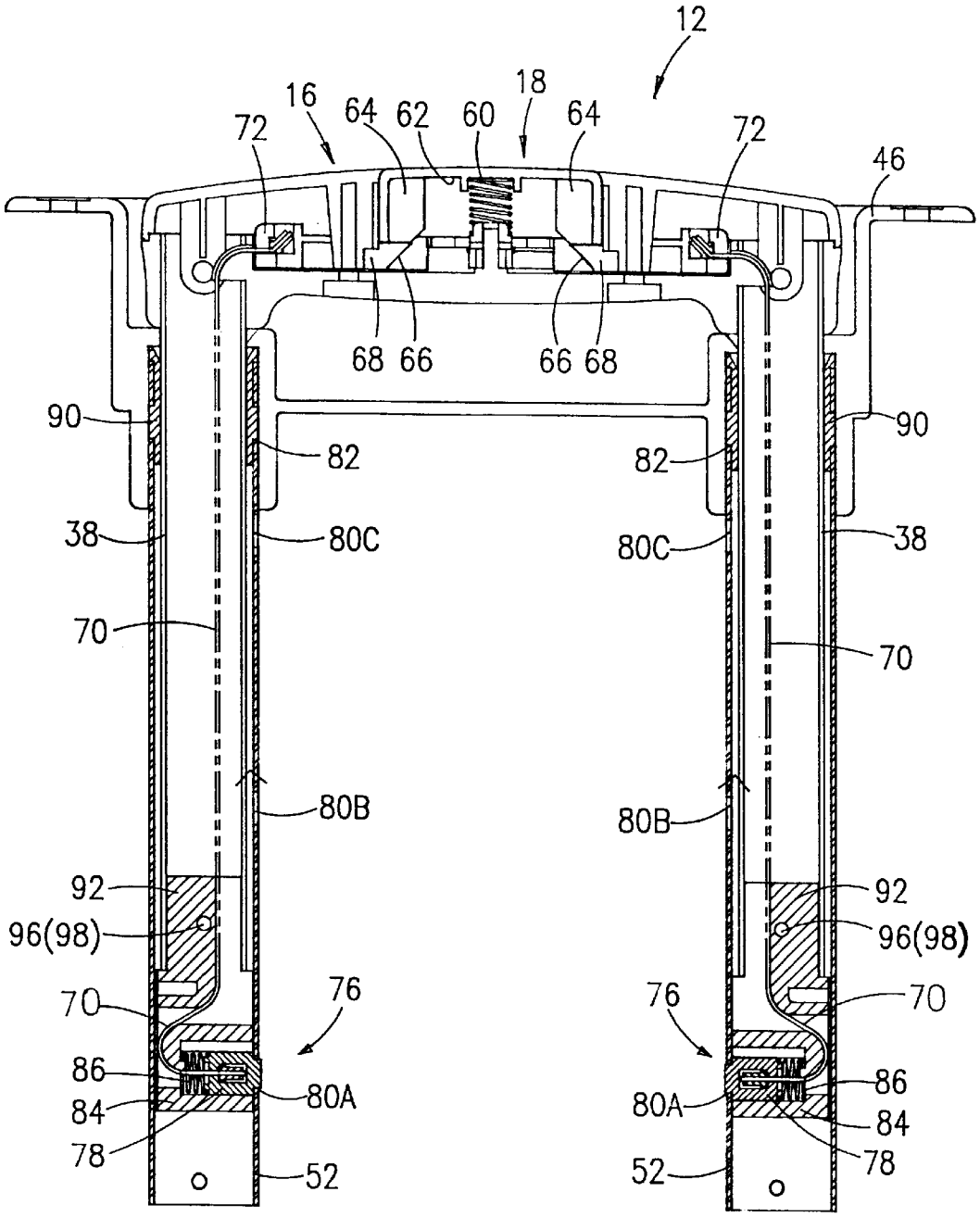
FIG. 6 is sectional view of the handle system of the present invention wheeled luggage with locking pins engaged to the lower apertures in the outer tubes.

FIG. 6 is sectional view of the handle system 12 of the present invention with locking pins 78 engaged to the lower apertures 80A in the outer tubes 52. It is seen that push button 18 operates by a compressible spring 60 which supports a bottom surface 62 of push button 18. Two wedges 64 projecting downwardly from the bottom of push button 18 and are arranged symmetrically to the center of push button 18. The wedges 64 are equipped with inclined bottom surfaces 66 which engage a pair of sliding blocks 68 such that when push button 18 is pressed downwardly against the spring 60, the inclined surfaces 66 engage sliding blocks 68 and pull them toward the center. Flexible cables 70 attached to sliding blocks 68 through flexible cable mounting blocks 72 are thus pulled up. The lower ends of flexible cables 70 are operatively attached to the locking mechanisms 76 which will be described in detail later.

Figure 7:
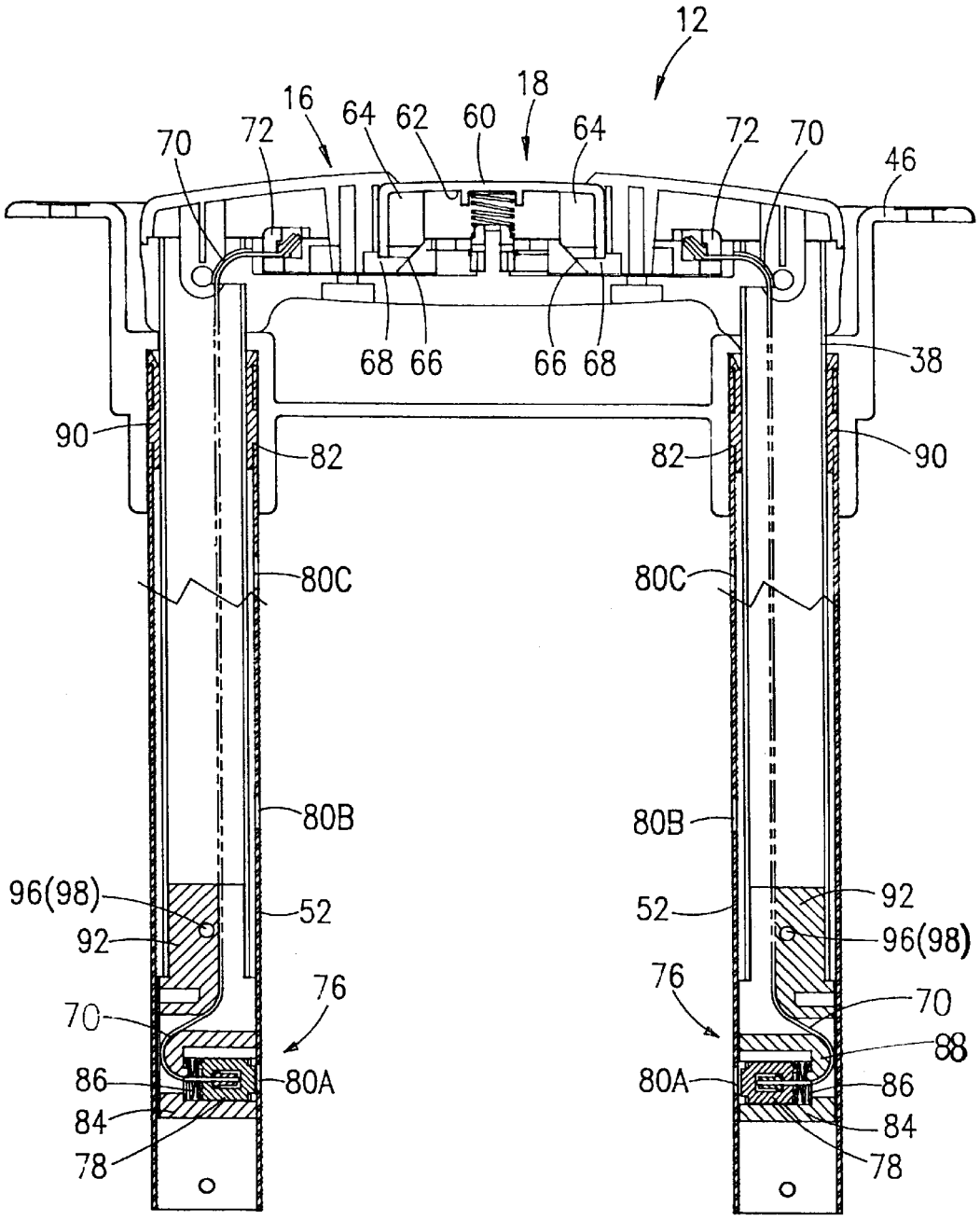
FIG. 7 is sectional view of the handle system of the present invention wheeled luggage with push button in a pressed-down position and locking pins disengaged from the lower apertures.

FIG. 7 is sectional view of the handle system 12 with push button 18 in a pressed-down position and locking pins 78 of locking mechanisms 76 disengaged from the lower apertures 80A such that inner tubes 38 are slidable in outer tubes 52.

Figure 8:
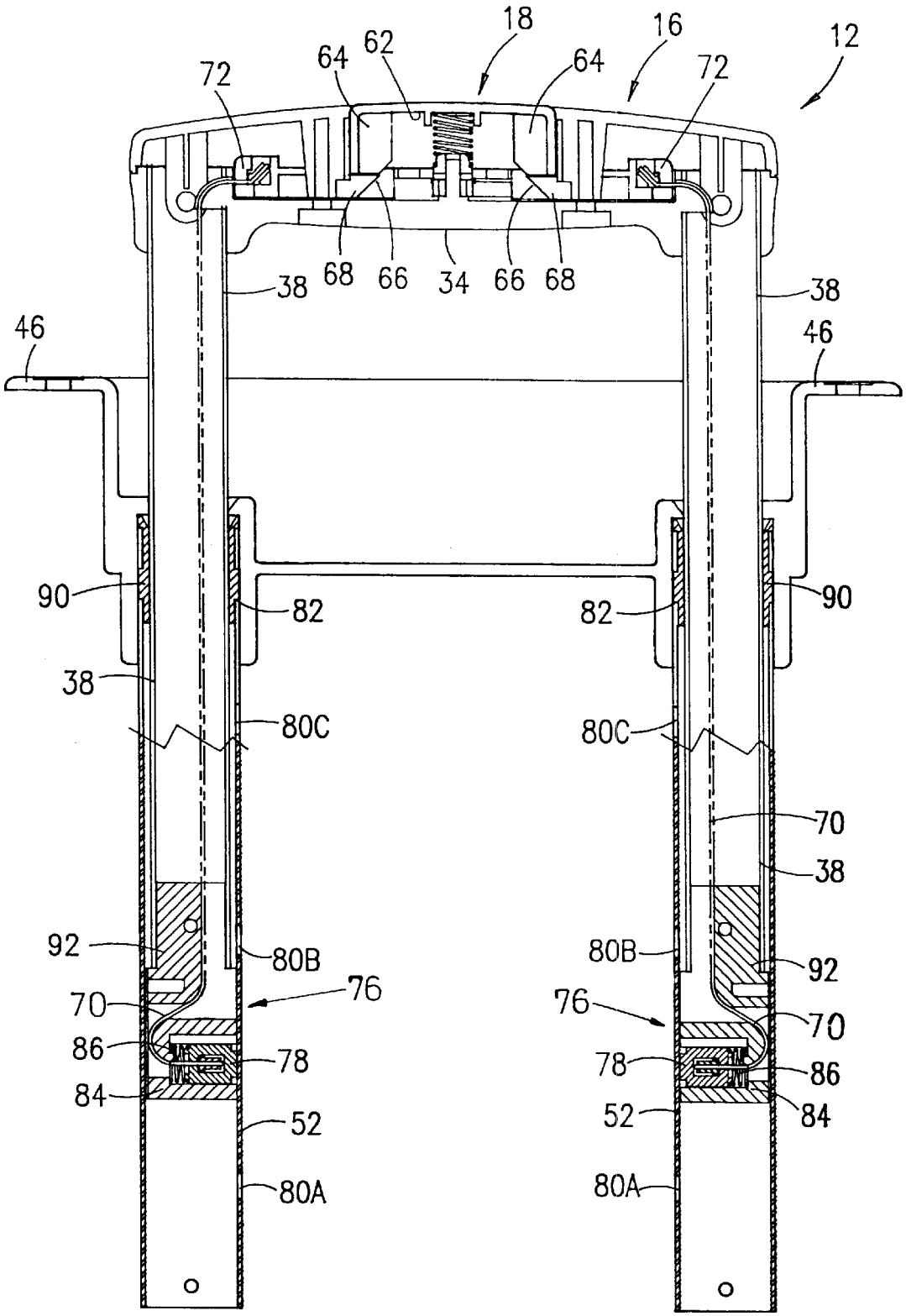
FIG. 8 is sectional view of the handle system of the present invention wheeled luggage with push button in a released position and locking pins disengaged from the lower apertures in the outer tubes such that inner tubes are slidable in the outer tubes.

FIG. 8 is sectional view of the handle system 12 with push button 18 in a released position and locking pins 78 of locking mechanisms 76 disengaged from the lower apertures 80A in the outer tubes 52 such that inner tubes 38 may slide freely in the outer tubes 52.

Figure 9:
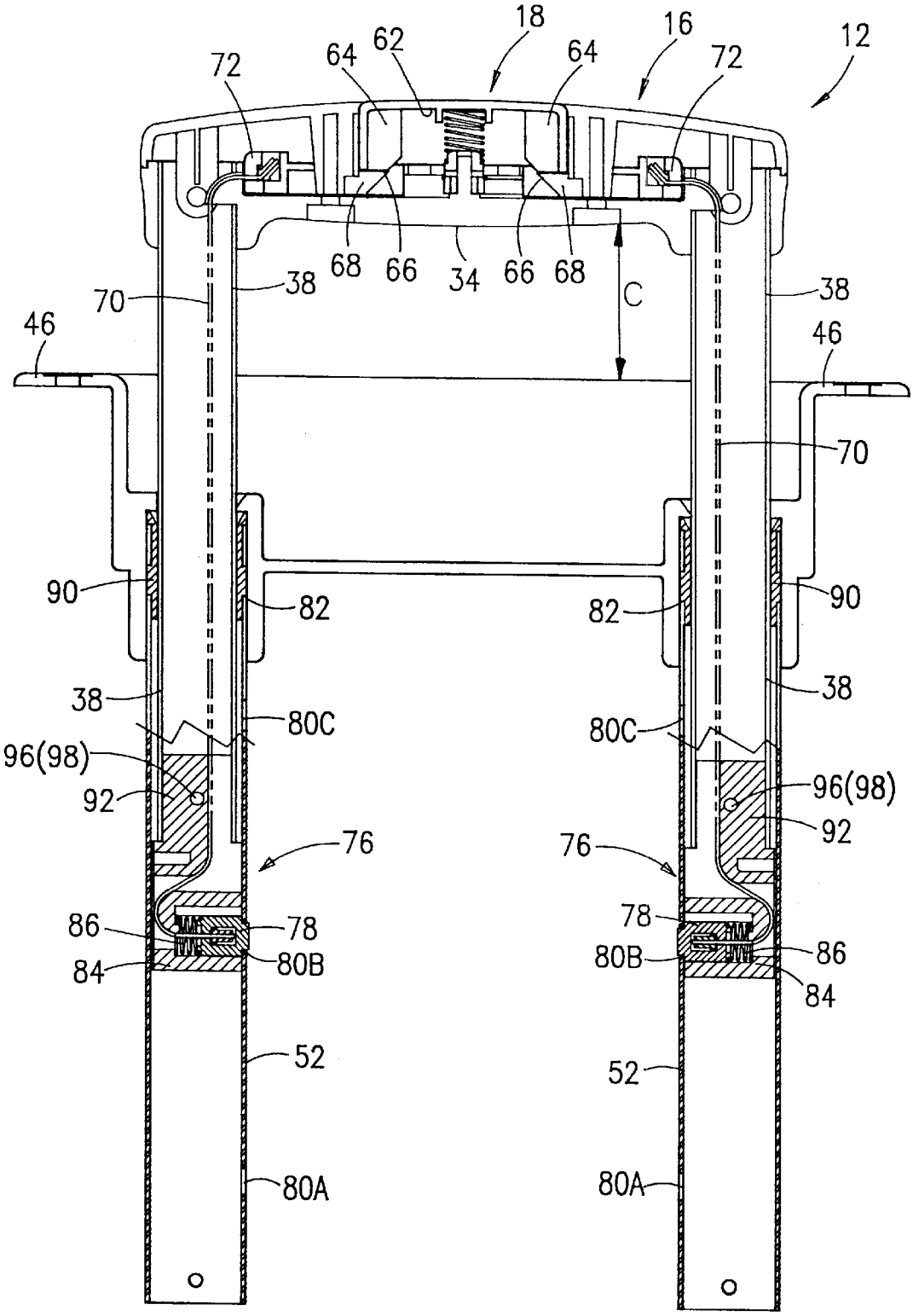
FIG. 9 is sectional view of the handle system of the present invention wheeled luggage with push button in a released position and locking pins engaged to the middle apertures in the outer tubes such that handle grip is locked in a partially extended position for carrying the luggage.

FIG. 9 is sectional view of the handle system 12 with push button 18 in a released position and locking pins 78 of locking mechanisms 76 engaged to the middle apertures 80B in the outer tubes 52 such that handle grip 16 is locked in a partially extended position for carrying the luggage 10. Note that the bottom surface 34 of handle grip 16 and surface of top plate 46 has a distance "C", as previously shown in FIG. 5. Preferably, the distance for "C" is between about 0.5 inch and about 6 inch.

Figure 10:
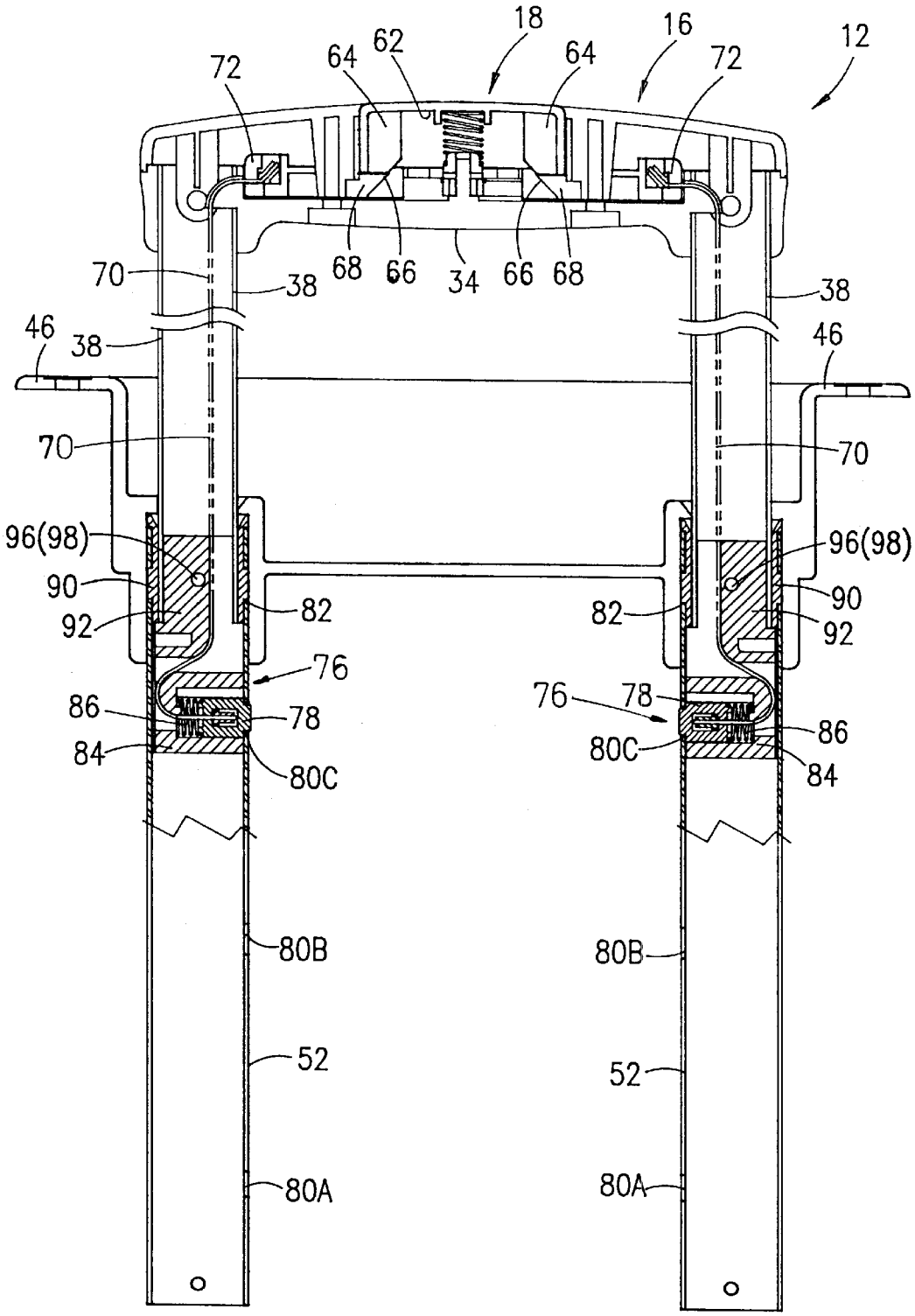
FIG. 10 is sectional view of the handle system of the present invention wheeled luggage with push button in a released position and locking pins engaged to the upper apertures in the outer tubes such that handle grip is locked in fully extended position for pulling the luggage.

FIG. 10 is sectional view of the handle system 12 with push button 18 in a released position and locking pins 78 engaged to the upper apertures 80C in the outer tubes 52 such that handle grip 16 is locked in fully extended position for pulling the luggage 10 as further shown in FIG. 14 later.

In view of the above sectional views of handle system 12, it is seen that locking pin 78 slidingly engaged a lock house 84 is pulled by flexible cable 70 against a compressible spring 86. The housing 84 is further provided with a smoothly curved portion 88 to facilitate the sliding of flexible cable 70 on the housing 84. It is also seen that lock housing 84 is mounted to inner tube 38 at an upper end 92 and further engages the interior cavities (not shown) of outer tube 52 through a mounting bracket 90 which is locked at upper holes 82-82 of the upper portion of the outer tube 52. The upper end 92 of lock housing 84 is removably attached to inner tube 38 through a pin 96 and an aperture 98 in the inner tube 38.

Figure 11C:
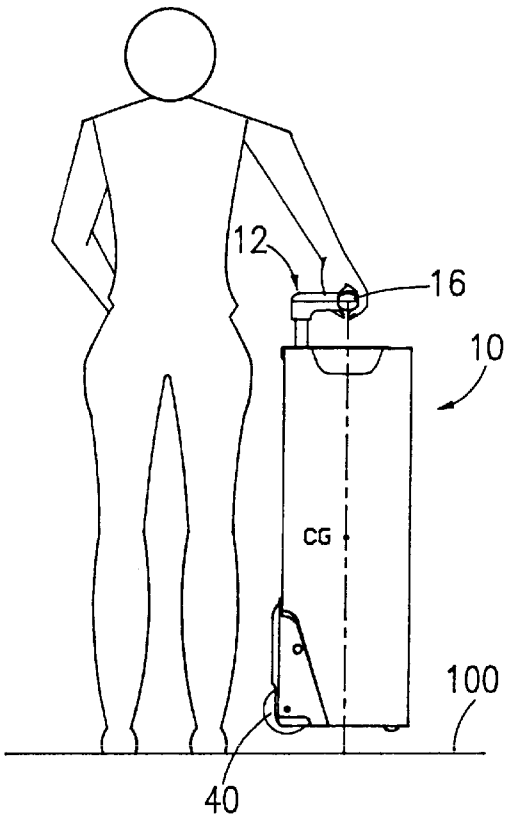
FIGS. 11A, 11B, and 11C are illustrations of the present invention handle system that is designed with the center line of handle grip coincided with the center line of luggage in three different bezel designs for storing the handle grip.
Figure 11B:
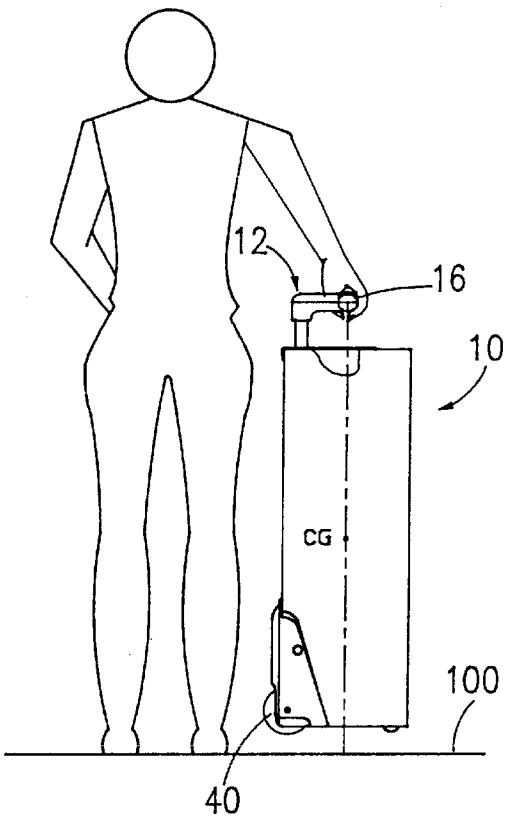
Figure 11A:
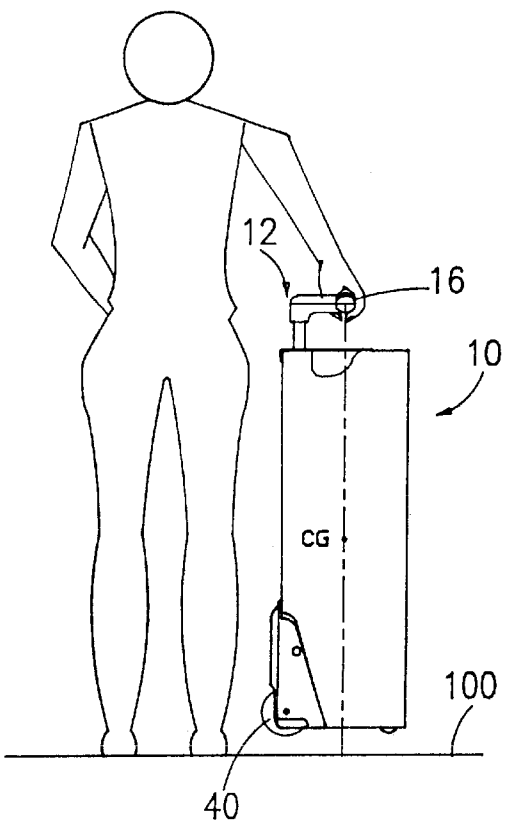

FIGS. 11A, 11B, and 11C illustrate wheeled luggage without off-centered feature for the handle grip 16. It is seen that in these illustrations, the center line of handle grip 16 is designed to coincide with the center line of luggage 10 such that when the luggage is picked up by handle grip 16, the luggage 10 is perpendicular to ground surface 100. Therefor, when a luggage 10 is carried by hand, the wheels 40 is accordingly positioned perpendicular to ground surface 100 not interfering with the movement of the user. In this manner, both center lines pass through the center of gravity CG of the luggage. FIGS. 11A, 11B and 11C each illustrates a different bezel design for storing the handle grip 16.

Figure 12C:
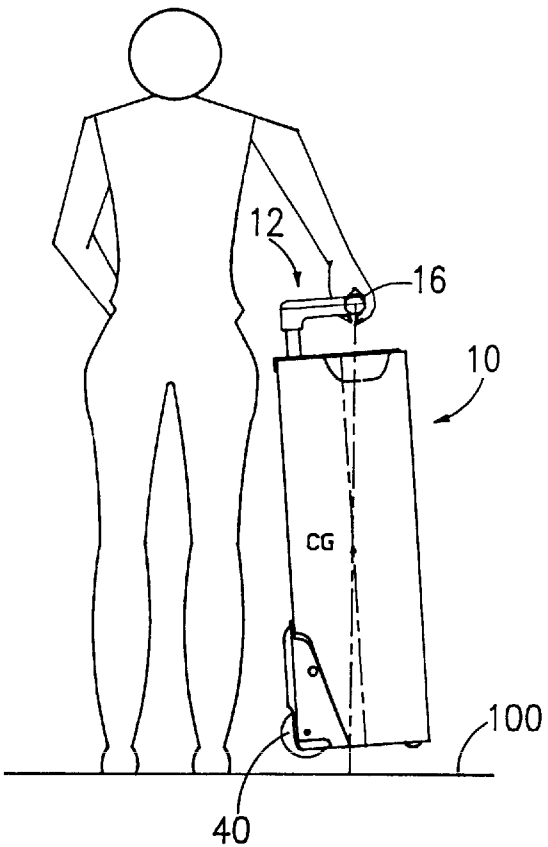
FIGS. 12A, 12B, and 12C are illustrations of the present invention handle system that is designed with the center line of handle grip off-centered with the center line of luggage showing the novel tilt y feature of the dual-purpose handle system.
Figure 12B:
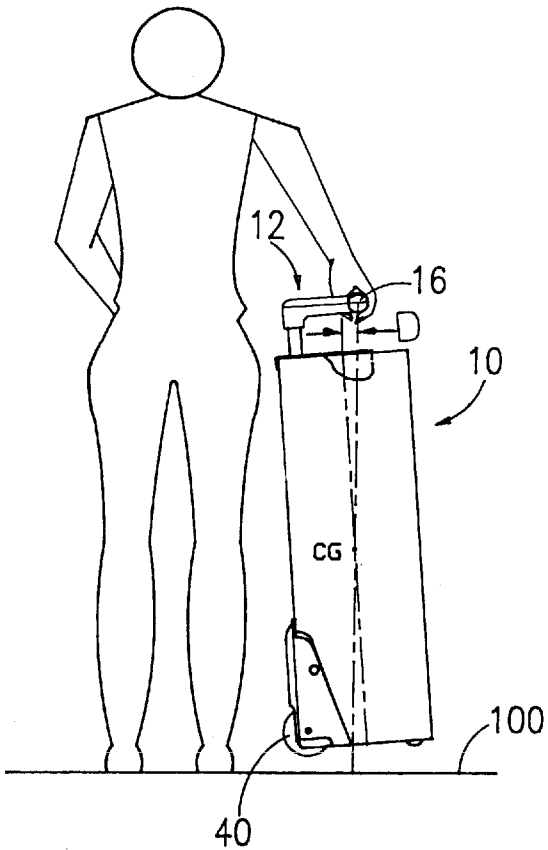
Figure 12A:
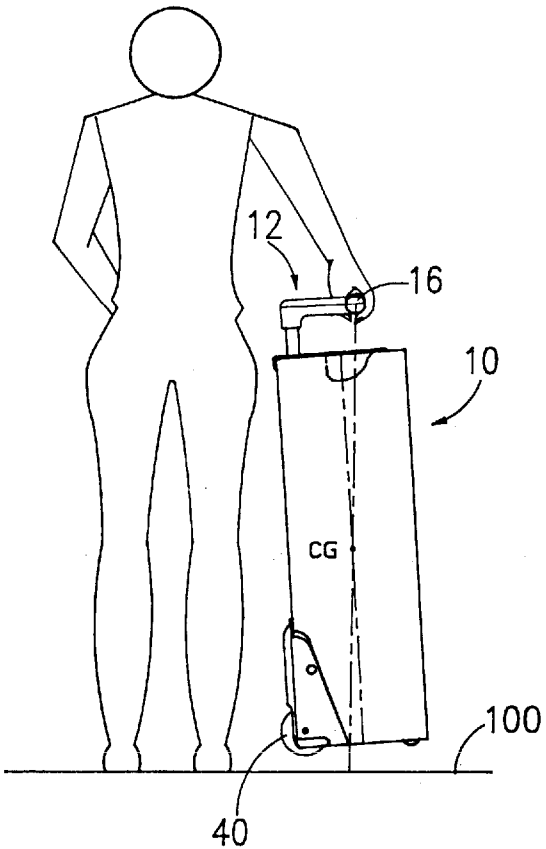

FIGS. 12A, 12B, and 12C illustrate wheeled luggage 10 of the present invention which incorporates the dual-purpose, off-centered handle system 12. It is seen that based on the off-centered design, i.e., the center line of handle grip 16 is positioned at a distance "D" from the center line of luggage 10, luggage 10 tilts away (specifically, the wheels 40 tilt away) from the user when luggage is picked up and carried. Preferably, the distance "D" is between about 0.1 inch and about 2 inch. Note that in this embodiment, handle grip 16 is off-centered to the right of center line of luggage 10 such that luggage should be carried with wheels toward user, and both center lines also pass through the center of gravity CG of the luggage. FIGS. 12A, 12B, and 12C each illustrates a different bezel design for storing the handle grip 16.

Figure 13C:
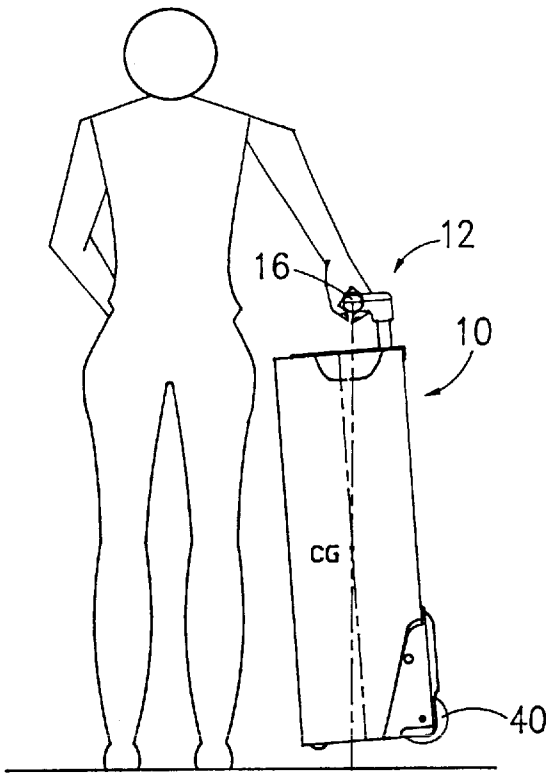
FIGS. 13A, 13B, and 13C are illustrations of the present invention handle system that is designed off-centered in an opposing direction to those shown in FIGS. 12A–12C on the other side of the center line showing the novel tilt-away feature of the dual-purpose handle system.
Figure 13B:
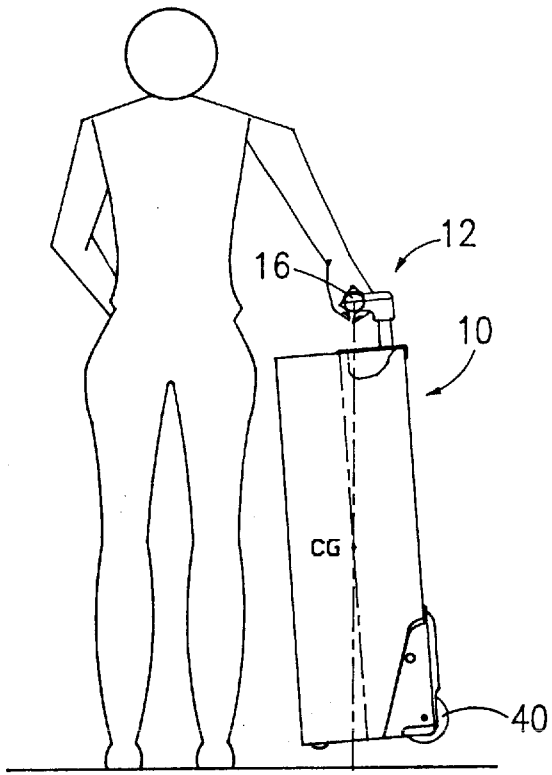
Figure 13A:
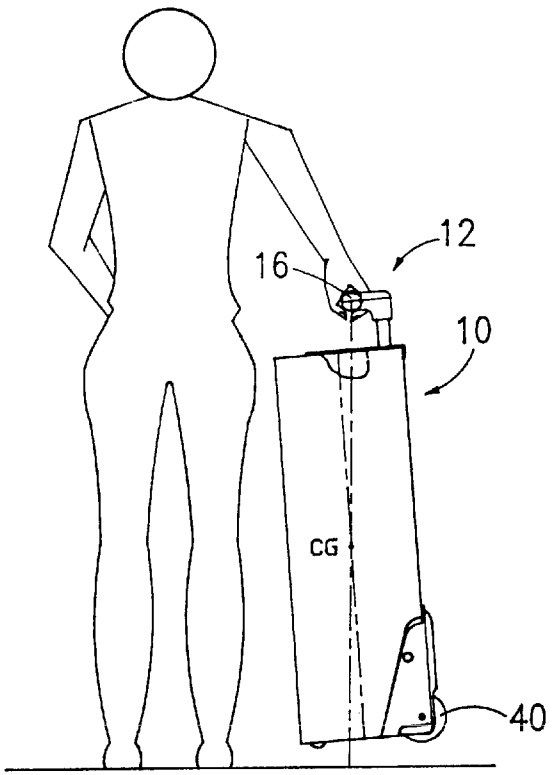

FIGS. 13A, 13B, and 13C are further illustrations of the present invention dual-purpose, off-centered handle system 12 for pulling and carrying luggage 10. Note that in this embodiment, the center line of handle grip 16 is designed to the left of center line of luggage 10, or closer to the wheels 40. In this design, the luggage should be carried with the wheels away from user such that the lower end of luggage 10 tilts away from the user. Similarly, three different bezel designs are shown in these figures.

Figure 14:
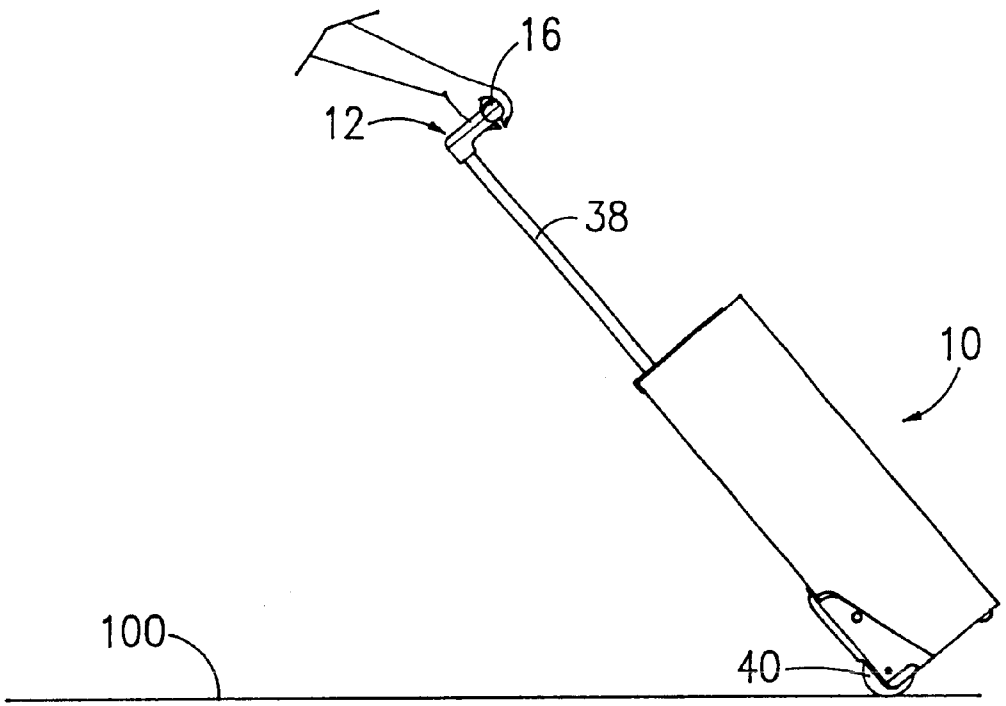
FIG. 14 is an illustration of the present invention wheeled luggage with the dual-purpose handle system in a fully extended position for operating the luggage on wheels.

FIG. 14 illustrates the handle system 12 in a fully extended position such that handle grip 16 can be pulled with wheels 40 rolling on the ground surface 100.

While the invention herein disclosed has been described by means of specific embodiments, numerous modifications and variations could be made thereto by those skilled in the art without departing from the scope of the invention set forth in the claims.

What is claimed is:

1. Wheeled luggage comprising:

a handle assembly having a handle grip with a push button, a pair of identical outer tubes, and a pair of identical inner tubes slidingly engaged with the outer tubes;

wheels mounted to a bottom of the luggage for facilitating transporting of the luggage; and a locking device mounted to the inner tubes having locking pins facing each other for engaging a plurality of apertures provided in the outer tubes in a stowed-away position, partially extended position, or fully extended position;

wherein the handle grip is off-center from a center line of the luggage in a longitudinal direction across the top of the luggage within a predetermined distance, thereby allowing the bottom of the luggage to tilt away from user for not interfering with the user's movement and, wherein the handle grip is lifted above the top of the luggage at a distance between about 0.5 inch to about 6 inch in the partially extended position.

2. The wheeled luggage of claim 1, wherein the predetermined off-center distance of the handle grip from the center line of the luggage in the longitudinal direction across the top of the luggage is between about 0.1 inch and about 2 inches.

3. The wheeled luggage of claim 1, wherein the handle grip comprises a pair of parallel members and a grip member connected between the parallel members forming a substantially U-shaped member.

4. The wheeled luggage of claim 1, further comprising a mechanism for disengagement of the locking pins from the apertures wherein the push button is connected by flexible steel cables in the inner tubes to the locking pins.

5. The wheeled luggage of claim 1, wherein the plurality of apertures comprise an upper aperture, a middle aperture, and a lower aperture.

6. The wheeled luggage of claim 1, wherein a bezel is provided on a top of the luggage for receiving the handle assembly.

7. Wheeled luggage comprising:

a handle assembly having a handle grip with a push button, a pair of identical outer tubes, and a pair of identical inner tubes slidingly engaged with the outer tubes;

wheels mounted to a bottom of the luggage for facilitating transporting of the luggage; and a locking device mounted to the inner tubes having locking pins facing each other for engaging a plurality of apertures provided in the outer tubes in a stowed-away position, partially extended position, or fully extended position;

wherein a center line of the handle grip coincides with a center line of the luggage in a longitudinal direction across the top of the luggage, thereby allowing the bottom of the luggage to be positioned perpendicular to a ground surface for not interfering with the user's movement, and wherein the handle grip is lifted above the top of the luggage at a distance between about 0.5 inch to about 6 inches in the partially extended position.

8. The wheeled luggage of claim 7, wherein the handle grip comprises a pair of parallel members and a grip member connected between the parallel members forming a substantially U-shaped member.

9. The wheeled luggage of claim 7, further comprising a mechanism for disengagement of the locking pins from the apertures wherein the push button is connected by flexible steel cables in the inner tubes to the locking pins.

10. The wheeled luggage of claim 7, wherein the plurality of apertures comprise an upper aperture, a middle aperture, and a lower aperture.

11. The wheeled luggage of claim 7, wherein a bezel is provided on a top of the luggage for receiving the handle assembly.

12. Wheeled luggage comprising:

a handle assembly having a handle grip with a push button, a pair of identical outer tubes, and a pair of identical inner tubes slidingly engaged with the outer tubes;

wheels mounted to a bottom of the luggage for facilitating transporting of the luggage; and a locking device mounted to the inner tubes having locking pins facing each other for engaging a plurality of apertures provided in the outer tubes in a stowed-away position, partially extended position, or fully extended position;

wherein the handle grip is off-centered from a center line of the luggage in a longitudinal direction across the top of the luggage within a predetermined distance, thereby allowing the bottom of the luggage to tilt away from user for not interfering with the user's movement and, wherein the predetermined off-center distance of the handle grip from the center line of the luggage in the longitudinal direction across the top of the luggage is between about 0.1 inch and about 2 inches.

13. The wheeled luggage of claim 12, wherein the handle grip comprises a pair of parallel members and a grip member connected between the parallel members forming a substantially U-shaped member.

14. The wheeled luggage of claim 12, further comprising a mechanism for disengagement of the locking pins from the apertures wherein the push button is connected by flexible steel cables in the inner tubes to the locking pins.

15. The wheeled luggage of claim 12, wherein the plurality of apertures comprise an upper aperture, a middle aperture, and a lower aperture.

16. The wheeled luggage of claim 12, wherein a bezel is provided on a top of the luggage for receiving the handle assembly.

* * * * *